US006142386A

United States Patent [19]

Spenser

[11] Patent Number: 6,142,386

[45] **Date of Patent: *Nov. 7, 2000**

[54] ROTARY SPRINKLER WITHOUT DYNAMIC SEALS

[75] Inventor: Benjamin Spenser, Zichron Yaacov, Israel

[73] Assignee: Dan Mamtirim, Hegalil Haelion, Israel

[ * ] Notice: This patent issued on a continued prosecution application filed under 37 CFR 1.53(d), and is subject to the twenty year patent term provisions of 35 U.S.C. 154(a)(2).

[21] Appl. No.: 09/091,275

[22] PCT Filed: Dec. 3, 1996

[86] PCT No.: PCT/IL96/00172

§ 371 Date: Jun. 12, 1998

§ 102(e) Date: Jun. 12, 1998

[87] PCT Pub. No.: WO97/21493

PCT Pub. Date: Jun. 19, 1997

[30] Foreign Application Priority Data

Dec. 12, 1995 [IL] Israel ..... 116338

[51] Int. Cl.[7] ..... B05B 3/04

[52] U.S. Cl. ..... 239/222.11

[58] Field of Search ..... 239/222.11, 237, 239/241, 222.17

[56] References Cited

U.S. PATENT DOCUMENTS

| | | | |
|---|---|---|---|
| 1,373,372 | 3/1921 | Waite | 239/222.11 X |
| 2,009,478 | 7/1935 | Coles et al. | 299/67 |
| 2,501,736 | 3/1950 | Olsen | 239/222.11 X |
| 2,796,293 | 6/1957 | Becker . | |
| 2,990,120 | 6/1961 | Reynolds | 239/97 |
| 3,034,728 | 5/1962 | Hruby, Jr. . | |
| 3,521,822 | 7/1970 | Friedmann et al. | 239/206 |
| 3,602,431 | 8/1971 | Lockwood | 239/101 |
| 3,771,723 | 11/1973 | Ray | 239/206 |
| 4,493,458 | 1/1985 | Bron | 239/230 |
| 4,815,662 | 3/1989 | Hunter . | |
| 4,927,082 | 5/1990 | Greenberg et al. | 239/230 |
| 5,172,864 | 12/1992 | Spencer | 239/241 |
| 5,544,814 | 8/1996 | Spenser | 239/222.11 X |
| 5,718,381 | 2/1998 | Katzer et al. | 239/222.11 X |

FOREIGN PATENT DOCUMENTS

| | | | |
|---|---|---|---|
| 0466415 | 1/1992 | European Pat. Off. . | |
| 63882 | 9/1981 | Israel . | |
| 106138 | 3/1997 | Israel . | |
| 58-70821 | 4/1983 | Japan | 239/222.11 |

*Primary Examiner*—Kevin Weldon
*Attorney, Agent, or Firm*—Greer, Burns & Crain, Ltd.

[57] ABSTRACT

A rotary drive sprinkler comprising a housing with a water inlet for coupling to a water irrigation supply and an outlet nozzle. A drive shaft is rotatably retained within the housing and has a portion extending from the housing through the outlet nozzle, around which water is adapted to flow. A rotary distribution member is fixedly articulated to the portion of the shaft and has at least one deflection surface in stream communication with the outlet nozzle. The housing also accommodates a rotary drive mechanism for rotating the drive shaft and a speed regulating mechanism for regulating the speed of rotation of the distribution member. The arrangement is such that the sprinkler is devoid of any dynamic seals.

20 Claims, 3 Drawing Sheets

ROTARY SPRINKLER WITHOUT DYNAMIC SEALS

FIELD OF THE INVENTION

The present invention is in the field of rotary sprinklers and in particular it is concerned with a rotary sprinkler of the kind having a rotatable distributor.

BACKGROUND OF THE INVENTION

In the following description and claims, the term "rotatable distributor" or "rotary distributer" denotes rotatable outlet deflector nozzles and rotors adapted for establishing reactionary force components and which at times are also referred to as "swivels" or "reaction swivels".

Rotary sprinklers generally fall into two categories, generally referred to in the art as "sprayers" and "sprinklers". Sprayers, typically have essentially low flow rate and short irrigation range, that owing to the essentially high speed of revolution of the distributor, causing atomization of the water jet into spray.

The second category of rotary sprinklers, the so-called sprinklers, are suitable for use with essentially high flow rates and provide irrigation range than sprayers. However, such sprinklers require dynamic seals between the moving parts of the sprinkler. The higher the flow rate of a sprinkler, the larger the size of the seals which entails friction increase, resulting in wear of moving parts, etc.

U.S. Pat. No. 3,034,728 is directed to a lawn sprinkler comprising a water supply pipe vertically extending and formed with a water discharge opening at its upper end with a stem extending through the opening and a reaction-operated rotary drive for rotating the stem about a vertical axis. There is fitted a laterally extending head on the stem above the opening in which the undersurface of the head slopes upwardly and outwardly from the stem in order to deflect water issuing from the opening in a lateral direction and where the slope is uneven along the cross-section of the distribution head.

A serious drawback of the invention disclosed in the '728 patent is that it is devoid of any speed restriction means leading to a sprayer type sprinkler in which the water emitted is in the form of fine spray emitted to an essentially short range. Another serious disadvantage of that patent is that the stem rotatable within the sprinkler's housing has no bearing supports both at its top and bottom end, entailing unstable rotation of the distribution head and possible accelerated wear of various components.

It is an object of the present invention to provide anew and improved rotary drive sprinkler devoid of dynamic seals.

BRIEF SUMMARY OF THE INVENTION

According to the present invention there is provided a rotary drive sprinkler comprising a housing with a water inlet for coupling to a water irrigation supply;

an outlet nozzle of housing;

a drive shaft rotatably retained within the housing and having a portion extending from the housing through said outlet nozzle and around which water is adapted to flow;

a rotary distribution member fixedly articulated to a top end of said portion of the shaft and having at least one deflection surface being in stream communication with said outlet nozzle;

a rotary drive mechanism accommodated within the housing and adapted for rotating said drive shaft; and speed regulating means for regulating the speed of rotation of said distribution member;

the arrangement being such that the sprinkler is devoid of any dynamic seals.

In a preferred embodiment of the present invention said rotary drive mechanism is a water driven turbine or a ball driven impeller, where said drive shaft is articulated to said turbine or impeller.

According to the present invention said at least one deflection surface generates reaction forces oriented in a direction substantially opposite to the direction of rotation of said drive shaft, thereby constituting said speed regulating means. In a specific embodiment of the invention said reaction forces are substantially balanced by a first rotary force applied on the drive shaft directly by water flow acting on said turbine or impeller, whereby the speed of rotation of said distribution member is substantially governed by a second rotary force imparted to said drive shaft by said rotary drive mechanism.

In one preferred embodiment of the invention, the sprinkler is insect and dirt protected wherein said distribution member is axially displaceable between a first position in which said outlet nozzle is substantially concealed, and a second position in which said outlet nozzle is exposed. The distribution member being axially displaceable by axial components of water flow reaction forces, wherein said axial displacement also protects said drive shaft against unintentional bending. In a specific embodiment, the distributor member withdraws into the housing such that an outlet end of the deflection surface of said distribution member is concealed within the housing. In a specific embodiment, there is provided a spring element biasing the distributer member downwardly.

By another embodiment of the present invention said distribution member comprises two or more deflection surfaces symmetrically disposed with respect to a longitudinal axis of the sprinkler.

The drive shaft of the sprinkler according to the present invention may be coaxial or offset with a longitudinal axis of the outlet nozzle and it may have a cylindric, polygonal or semi-circular cross-section, wherein the acentric drive shafts provide constant cleaning of the outlet nozzle inner wall as it rotates therein.

BRIEF DESCRIPTION OF THE DRAWINGS

For better understanding, the invention will now be described, by way of example only, with reference to the accompanying drawings, in which.

DETAILED DESCRIPTION OF SPECIFIC EMBODIMENTS

Figure 1:
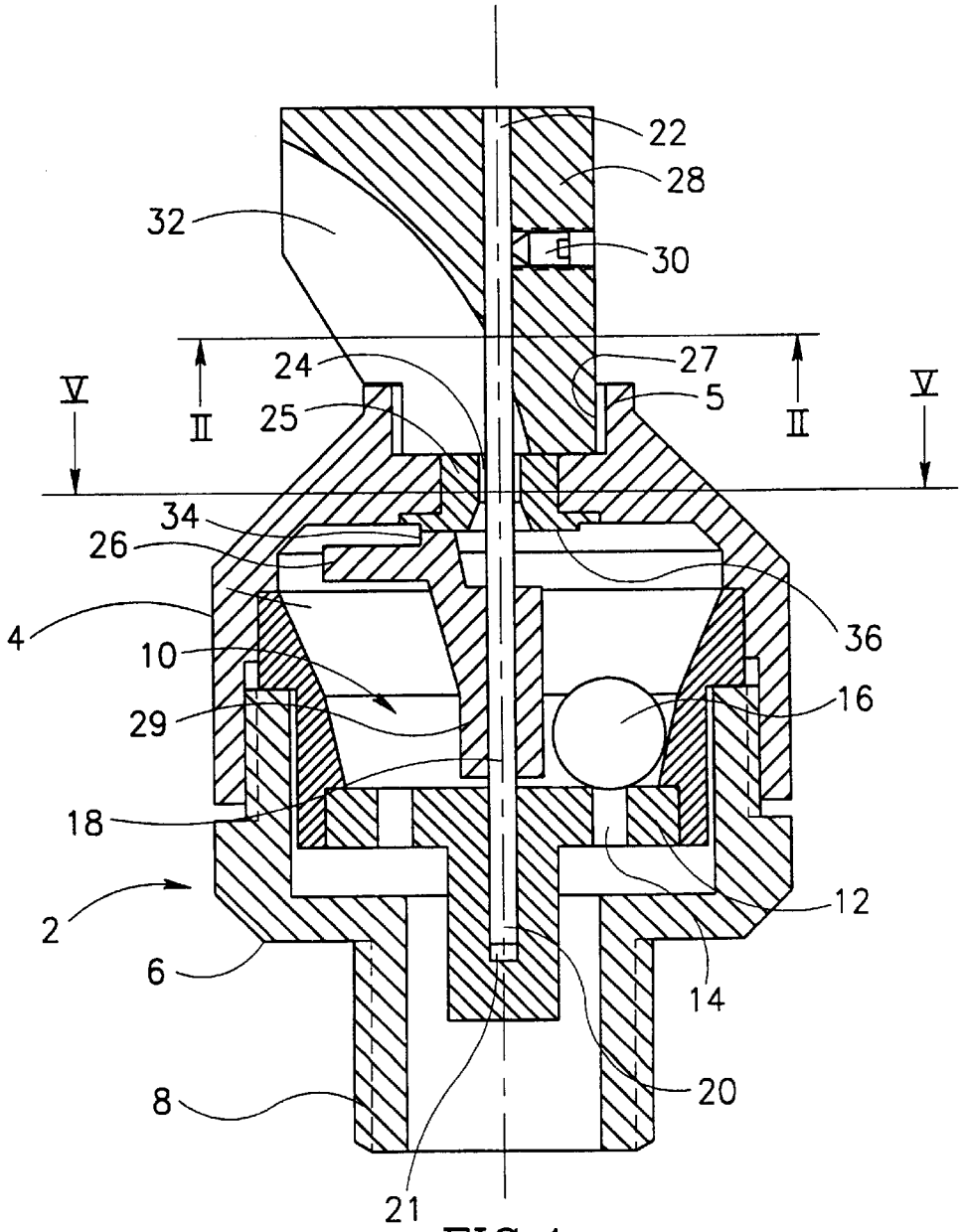
FIG. 1 is a longitudinal cross-section of a first embodiment of a sprinkler according to the present invention.

Reference is first made to FIG. 1 of the drawings illustrating a rotary sprinkler comprising a housing generally designated 2, consisting of an upper casing 4 screw coupled to a lower casing 6, the latter formed with a water inlet 8 and a drive motor designated 10.

The drive motor 10 comprises a stationary planar base 12 having four symmetrically disposed and tangentially directed, water inlet ports 14 and a steel drive ball 16 located within the motor 10 so as to freely move on the base 12.

A drive shaft 18, made of steel and preferably of a titanium alloy, has a bottom end 20 rotatably supported in a bearing-like fashion within a cavity 21 within the base 12 and has a top end portion 22 projecting through an outlet nozzle 24 formed in a plug member 25 accommodated within the upper casing 4. The drive shaft 18 is fixed within a sleeve portion 29 of the imeler, formed with a laterally extending impeller element 26.

A distribution member 28 is fixed by a set screw 30 to the top end portion 22 of the driving shaft 18 and has a curved deflection surface 32 configured to deflect an axial jet emitted from the outlet nozzle 24 into an essentially radial direction. A bottom portion 27 of the distribution member 28 is rotatably received within an anular bearing portion 5 upwardly projecting from the upper casing 4. This arrangement ensures that the drive shaft 18 is rotatably and coaxially retained with respect to a longitudinal axis of the housing 2.

Figure 2:
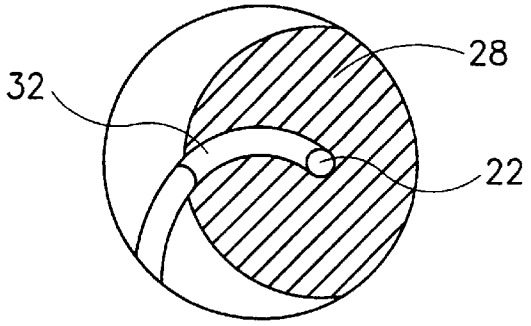
FIG. 2 is a cross-section along line II—II in FIG. 1 of the drawings.

As seen in FIG. 2, which is a lateral cross-section through the distribution member 28, the deflection surface 32 is also tangentially curved, in a direction substantially opposed to the tangential directed water inlet ports 14.

In operation, water flows into the sprinkler housing 2 through the water inlet 8 and into the driving motor 10, via the tangentially disposed water inlet ports 14. In consequence, the drive ball 16 is rotatably displaced within the motor 10 by tangent water jets and it then impacts the laterally projecting impeller element 26, resulting in continuous incremental rotational displacement of the impeller element 26 and the associated distributor member 28, with water flowing out through the outlet nozzle 24, into the deflection surface 32, whereby it is radially distributed. The outlet nozzle 24 is sufficiently long so as to serve also as a liquid rectifier as known per se.

The tangentially opposed deflection surface 32 generates tangential reaction forces oriented in a direction substantially opposed to the direction of rotation of the water within the motor 10, such that forces applied by water flow directly on the impeller element 26 to the drive shaft 18, are substantially balanced by the tangential reaction forces generated by the deflection surface 32, whereby the speed of rotation of the distribution member 28 is essentially that imparted by the ball 16 impacting the impeller element 26.

The arrangement of the drive shaft 18 extending through the outlet 24, obviates dynamic seals which are typically provided in sprinklers and situated between two parts being in motion with respect to one another and having water flowing between or around the parts. By obviating the use of such seals, the sprinkler is less likely to be effected by dirt and friction ware.

If it is required to prevent axial displacement of the distribution member 28, the impeller element 26 is provided at a top surface thereof with a protrusion 34, bearing against a bottom surface 36 of the plug 25. The arrangement is such that the protrusion 34 bearing against surface 36 generates a friction force opposed to the rotational firces of the distribution member, thus constituting a speed restricting mechanism. It will be appreciated that in order to reduce the rotational speed of the distribution member 28 the protrusion 34 may be made larger i.e. to increase the contact surface with the bottom surface 36 of the plug 25. Alternatively, protrusion 34 may extend radially outwardly leading to the same effect of increasing the friction force.

Figure 4:
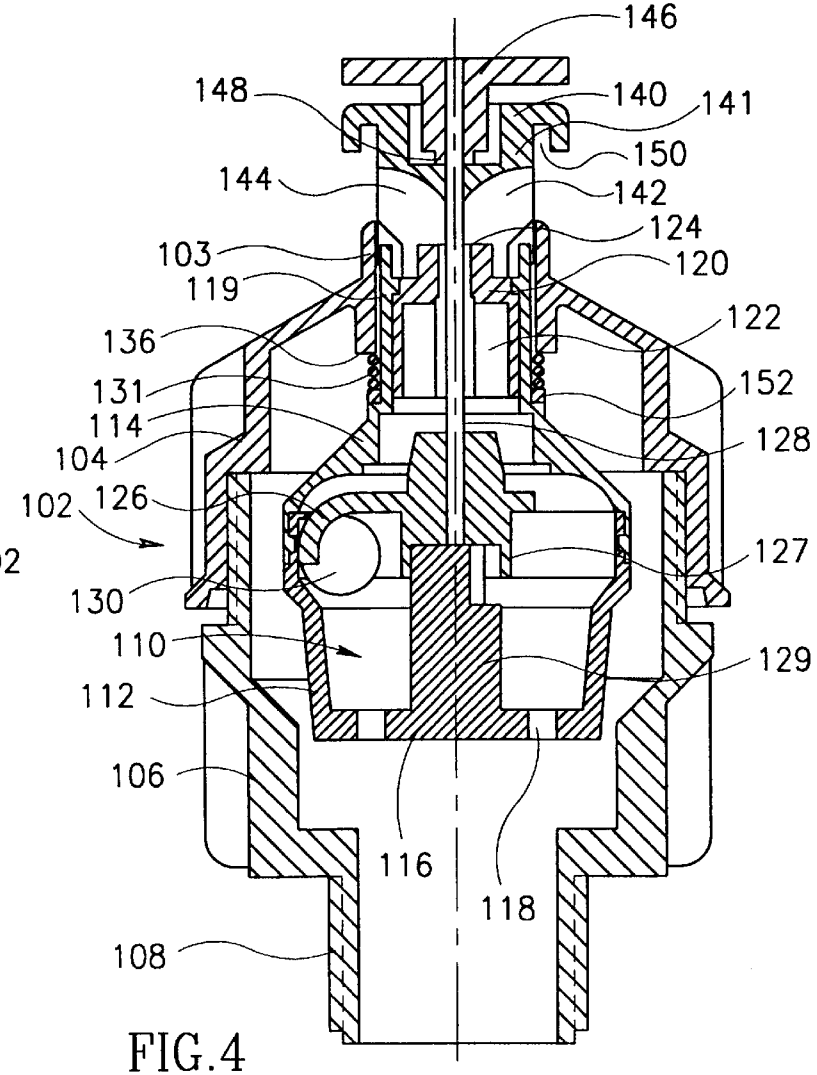
FIG. 4 is the same sprinkler as in FIG. 3, shown in operation.
Figure 3:
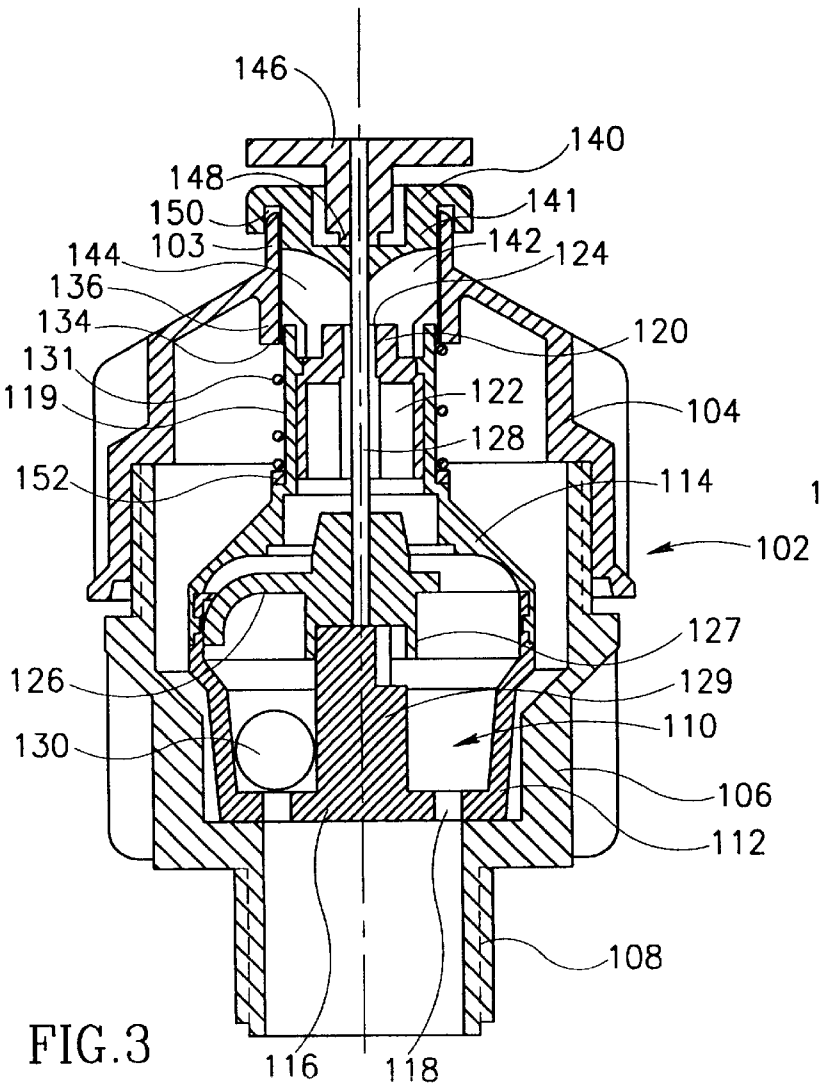
FIG. 3 is a longitudinal cross-sectional view of another embodiment of a sprinkler according to the present invention, shown in rest.
Figure 5A:
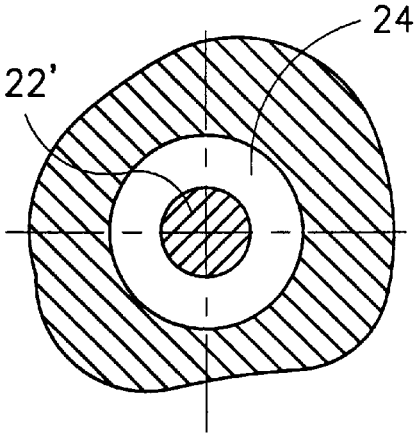
FIGS. 5(*a*) to 5(*d*) are cross-sectional views along line V—V in FIG. 1 illustrating different embodiments of a drive shaft used in the sprinkler according to the present invention.
Figure 5B:
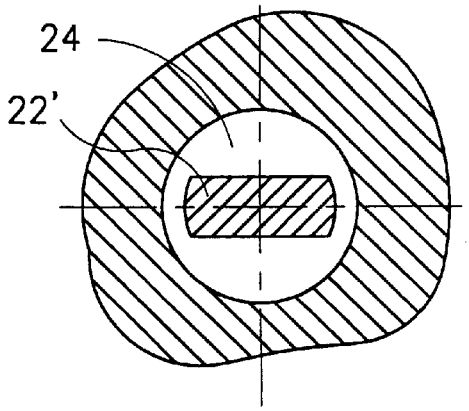
Figure 5C:
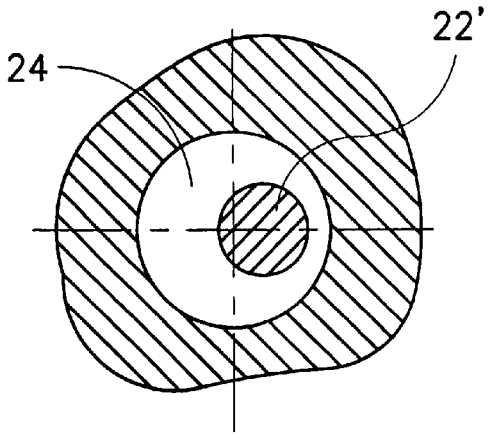
Figure 5D:
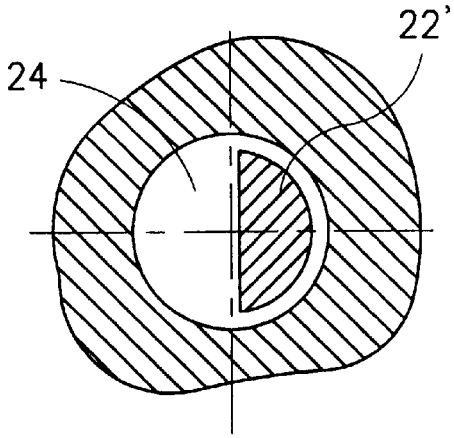

Attention is now directed to FIGS. 3 and 4 illustrating a preferred embodiment of the present invention.

Similar to the previous embodiment, the housing 102 consists of an upper casing 104 screw coupled to a lower casing 106 formed with a water inlet 108 and a drive motor 110. The drive motor 108 comprising a cup-like lower member 112 snapingly engaged with a top member 114. The lower member 112 comprises at a planar base 116 four tangentially disposed water inlet ports 118, A plug 120 is attached within an upwardly extending boss 119 at the top end of the top member 114, the plug 120 being provided with a chamber 122 serving as a flow rectifier and comprising an axially directed outlet nozzle 120.

An impeller member 126 is rotatably mounted within the motor 110 and is fixed to a drive shaft 128 extending through the nozzle 124. The drive shaft 128 is made of steel and preferably of a titanium alloy. A steel drive ball 130 is located within the motor 110 so as to freely move on the base 112. The impeller is formed at its lower end with a downward projecting shoulder 127 rotatably mounted over stem 129 projecting from the fixed cup-like member 112 of the drive motor 110.

A compression spring 131 has one end thereof bearing against an upward facing shoulder of the top member 114 and an opposed end bearing against a bottom wall 134 of a sleeve 136 integral at a top end of the upper casing 104, whereby the drive motor 110 and associated parts are downwardly biassed. The sleeve 136 is adapted for slidingly accommodating the boss 119 of the motor 110.

A distribution member 140 comprises two essentially opposed, curved deflection surfaces 142 and 144 configured to deflect an axial water jet emitted from the nozzle 124, in essentially opposed radial directions. As explained with regards to FIG. 2, the deflection surfaces 142 and 144 are also tangentially curved, in a direction substantially opposed to that of the water inlet ports 118, thus generating tangential reaction forces oriented in a direction substantially opposed to the direction of rotation of the water within the motor 110. A lower end 141 of the distribution member 140 is rotatably received within annular rim 103 upwardly projecting from the upper casing 104 of the housing 2, whereby the drive shaft 128 is rotatable and coaxially retained with respect to the longitudinal axis of the housing 102.

The distribution member 140 is fixed to the top end of the drive shaft 128 by a collet 146 screwingly fastened within a cavity 148 at a top of the distribution member 140.

At the top end of the distribution member 140 there is a downward facing annular groove 150, whereby at the inactive position of FIG. 3, the top portion of sleeve 136 is received within the annular groove 150, preventing dirt and insects from entering into the sprinkler. The downward displacement of the motor 110 and associated deflection member 140, is obtained by the spring 131.

In another embodiment, the biassing spring 131 is omitted and instead, a friction washer 152 is mounted on the upward facing shoulder of the top member 114 and in operation (position of FIG. 4), it engages the bottom wall 134 of the sleeve 136.

As seen in FIG. 4, in operation, water flows into the sprinkler housing 102 through the water inlet 108 displacing the motor 110 and associated deflector 140 upwards, against the biassing effect of the spring 131. Simultaneously, water enters into the driving motor 110, via the tangentially disposed water inlet ports 114. In consequence, the drive ball 130 is rotatably displaced within the motor 110 by the tangent water jets emitted from the ports 114 and it then impacts the laterally projecting impeller element 126, resulting in continuous incremental rotational displacement of the impeller element 126 along with the associated distribution member 140, with water flowing out through the outlet nozzle 124 radially distributed by the deflection surfaces 142 and 144, as already explained in connection with FIGS. 1 and 2.

Referring now to FIGS. 5(*a*) to 5(*d*) of the drawings, there are shown local sections of the drive shaft (22,128) within the circular outlet nozzle (24,124). In FIG. 5(a) the drive shaft 22' is a cylindric pin co-axial with the longitudinal axis of the outlet nozzle 24. In FIG. 5(*b*) the drive shaft 22" has an essentially rectangular cross-section, co-axial within the longitudinal axis of the outlet nozzle 24. In FIG. 5(*c*) the cylindric drive shaft 22'" is axially offset with respect to the longitudinal axis of the outlet nozzle 24 and in FIG. 5(*d*) the drive shaft 22"" has a semi-circular cross-section substantially co-axially disposed within the outlet nozzle 24"".

The alternatives illustrated in FIGS. 5(*b*) to 5(*d*) provide continuous cleaning of the outlet nozzle 24 by the drive shaft rotating within it scraping any dirt adhering on the inner walls of the outlet nozzle.

I claim:

1. A rotary drive sprinkler devoid of any dynamic seals and comprising:

a housing 2 with a water inlet 8 for coupling to a water irrigation supply and an outlet nozzle 24 of said housing 2;

a rotary drive mechanism 10 accommodated within said housing 2 and adapted for rotating a drive shaft 18;

a rotary distribution member 28 formed with at least one deflection recess 32 being in stream communication with said outlet nozzle 24; the invention characterized in that:

the drive shaft 18 has a portion 22 extending from the housing 2 through said outlet nozzle 24 and around which water is adapted to flow;

the drive shaft 18 is coaxially retained with respect to a longitudinal axis of the housing 2;

the rotary distribution member 10 is fixed to said portion 22 of the drive shaft 18;

the distribution member 10 is rotatably supported at a top end of the housing; and the sprinkler further comprises a speed restricting mechanism 34, 36; 14, 32 for reducing the speed of rotation of the drive shaft 18.

2. A rotary drive sprinkler according to claim 1, wherein the speed restricting mechanism 34, 36 is a friction responsive mechanism, whereby the speed of rotation of the drive shaft 18 is essentially constant regardless water supply pressure.

3. A rotary drive sprinkler according to claim 1, wherein the drive shaft 18 is rotatably supported by the housing 4 by a bottom end 27 of the rotary distribution member 28 being rotatably received within a corresponding bearing portion 5 upwardly projecting from the housing 4, and at a bottom end 20 of the drive shaft 18 which is rotatably supported within a corresponding cavity 21 fixed within the housing 4.

4. A rotary drive sprinkler according to claim 2, wherein said rotary drive mechanism 10, 110 is a ball-driven impeller 26, where said drive shaft 18 is fixed to a sleeve portion 29 of said impeller 26.

5. A rotary drive sprinkler according to claim 2, wherein said rotary drive mechanism 10, is a water driven turbine 26, where said drive shaft 18 is fixed to said turbine.

6. A rotary drive sprinkler according to claim 4 or 5, wherein a surface 34 of impeller 26 is in friction contact with a surface 36 of a stationary element 25, thereby constituting said speed restricting mechanism.

7. A rotary drive sprinkler according to claim 1, wherein said at least one deflection recess 32 generates reaction forces oriented in a direction substantially opposite to direction of rotation of said drive shaft 18, thereby reducing the rotational speed of the drive shaft.

8. A rotary drive sprinkler according to claim 7, wherein said reaction forces are substantially balanced by a first rotary force applied on the drive shaft 18 directly by water flow acting on said turbine or impeller 26, whereby the speed of rotation of said distribution member 28 is substantially governed by a second rotary force imparted to said drive shaft 18 by said rotary drive mechanism 10.

9. A rotary drive sprinkler according to claim 1, wherein said distribution member 140 is axially displaceable between a first position in which said outlet nozzle 124 is substantially concealed, and a second position in which said outlet nozzle 124 is exposed; said distribution member 140 being axially displaceable by axial components of water flow reaction forces.

10. A rotary drive sprinkler according to claim 9, wherein at said first position an outlet opening of each of the at least one deflection recess 142, 144 of said distribution member 140 is concealed within the housing 2.

11. A rotary drive sprinkler according to claim 9 or 10, wherein said distribution member 140 is downwardly biased by a spring member 131.

12. A rotary drive sprinkler according to claim 7, wherein said distribution member 140 comprises two or more deflection recesses 142, 144 symmetrically disposed with respect to the longitudinal axis of the sprinkler.

13. A rotary drive sprinkler according to claim 1, wherein said drive shaft is coaxial with a longitudinal axis of said outlet nozzle.

14. A rotary drive sprinkler according to claim 1, wherein said drive shaft 22*c* is axially offset with respect to a longitudinal axis of the outlet nozzle 24.

15. A rotary drives sprinkler according to claim 1, wherein said drive shaft 22*b* has a substantially polygonal cross-section.

16. A rotary drives sprinkler according to claim 1, wherein said drive shaft 22*d* has a semi-circular cross-section.

17. A rotary drive sprinkler according to claim 6, wherein said distribution member is downwardly biased by a spring member.

18. A rotary drive sprinkler according to claim 11, wherein said drive shaft has a substantially cylindric cross-section.

19. A rotary drive sprinkler according to claim 11 wherein said drive shaft has a substantially polygonal cross-section.

20. A rotary drive sprinkler according to claim 11, wherein said drive shaft has a semi-circular cross-section.

* * * * *